US012276215B1

(12) United States Patent
Redfern et al.

(10) Patent No.: US 12,276,215 B1
(45) Date of Patent: Apr. 15, 2025

(54) ANTI-CLATTER ENGINE BRAKE AND ENGINE HAVING SAME

(71) Applicant: Deere & Company, Moline, IL (US)

(72) Inventors: Kyle D. Redfern, Cedar Falls, IA (US); James P. Swaim, Waterloo, IA (US)

(73) Assignee: DEERE &COMPANY, Moline, IL (US)

( * ) Notice: Subject to any disclaimer, the term of this patent is extended or adjusted under 35 U.S.C. 154(b) by 1 day.

(21) Appl. No.: 18/521,640

(22) Filed: Nov. 28, 2023

(51) Int. Cl.

| | |
|---|---|
| ***F01L 13/06*** | (2006.01) |
| ***F01L 1/18*** | (2006.01) |
| ***F01L 9/10*** | (2021.01) |
| ***F01L 9/40*** | (2021.01) |

(52) U.S. Cl.
CPC ..... *F01L 13/06* (2013.01); *F01L 1/181* (2013.01); *F01L 9/10* (2021.01); *F01L 9/40* (2021.01); *F01L 2760/00* (2013.01)

(58) Field of Classification Search
CPC ..... F01L 1/181; F01L 13/06; F01L 2760/00; F01L 9/10
See application file for complete search history.

(56) References Cited

U.S. PATENT DOCUMENTS 11,181,018 B1 11/2021 Erickson et al.

*Primary Examiner* — Ngoc T Nguyen
(74) *Attorney, Agent, or Firm* — KLINTWORTH & ROZENBLAT IP LLP

(57) ABSTRACT

An engine brake for an engine, having a rocker shaft carrying rocker arms along a rocker shaft, has an eccentric mounted to the rocker shaft and couples one of the rocker arms to the rocker shaft to pivot eccentrically about the rocker shaft as the eccentric pivots. The eccentric may take a braked condition or an unbraked condition. An actuator is capable of pivoting the eccentric about the rocker shaft to move the eccentric from the unbraked condition to the braked condition. An anti-clatter assembly is movable from an active state associated with the unbraked position of the eccentric to an inactive state associated with the braked condition of the eccentric. The anti-clatter assembly provides to the eccentric a restraining force in the active state and a yielding force in the inactive state. The restraining force is greater than the yielding force. The restraining force is sufficient to impede the eccentric from pivoting about the rocker shaft in the unbraked condition. The yielding force is insufficient to impede pivoting of the eccentric in the braked condition.

20 Claims, 11 Drawing Sheets

ANTI-CLATTER ENGINE BRAKE AND ENGINE HAVING SAME

CROSS-REFERENCE TO RELATED APPLICATION(S)

Not applicable.

STATEMENT OF FEDERALLY SPONSORED RESEARCH OR DEVELOPMENT

Not applicable.

FIELD OF THE DISCLOSURE

This disclosure generally relates to internal combustion engines and engine brakes that operate to interrupt the thermodynamic cycle of one or more engine cylinders.

BACKGROUND OF THE DISCLOSURE

Heavy-duty work vehicles, such as those used in the agricultural, construction, forestry, and mining industries, may utilize various propulsion systems and drive trains to provide tractive power to the ground-engaging wheels or tracks for travel and work operations of the work vehicle. Internal combustion engines, including various compression ignition engines (such as diesel engines), may provide the sole or primary power source for tractive and work operations of these work vehicles. To aid in deceleration and stopping of the work vehicles, which are large, heavy machines, often carrying heavy loads, and generating large kinetic energies, engine brakes may be employed. Engine brakes operate in different ways including by interrupting the combustion cycle of one or more cylinders of the engine. This may be accomplished in various ways but generally involves temporarily and selectively controlling the valves of the braked cylinders to decompress the cylinders by venting their combustion chambers to the exhaust manifold, either pre- or post-combustion, to prevent an effective power stroke. During engine braking, the engine effectively absorbs the energy from the braked cylinders and works to decelerate the work vehicle. Such compression release engine brakes absorb the vehicle's energy by applying it to the work involved in compressing air in the cylinders and releasing it as exhaust before a power stroke can be achieved.

SUMMARY OF THE DISCLOSURE

The disclosure provides an anti-clatter engine brake, and an engine having such an engine brake.

In particular, the disclosure provides an engine brake for an engine having a rocker shaft carrying rocker arms. The engine brake has an eccentric mounted to the rocker shaft and coupling one of the rocker arms to the rocker shaft to pivot eccentrically as the eccentric pivots about the rocker shaft. The eccentric takes a braked condition or an unbraked condition. An actuator is capable of pivoting the eccentric about the rocker shaft to move the eccentric from the unbraked condition to the braked condition. An anti-clatter assembly is movable from an active state associated with the unbraked position of the eccentric to an inactive state associated with the braked condition of the eccentric. The anti-clatter assembly provides to the eccentric a restraining force in the active state and no force or a force in the inactive state. The restraining force is greater than the yielding force.

The restraining force is sufficient to impede the eccentric from pivoting about the rocker shaft in the unbraked condition. The yielding force is insufficient to impede pivoting of the eccentric in the braked condition.

In one or more other aspects or embodiments, the disclosure provides an engine brake in which the anti-clatter assembly includes a latch pin configured to engage the eccentric to provide the restraining force in the active state. The engine brake may include an engine brake housing defining, at least in part, a hydraulic circuit and a pressure chamber in fluid communication with the hydraulic circuit. The latch pin is disposed in the pressure chamber and is driven by hydraulic pressure of the hydraulic circuit into the active position in which the latch pin physically abuts the eccentric to impede the eccentric from pivoting about the rocker shaft in the unbraked condition. The eccentric includes a recess into which the latch pin is disposed in part. The latch pin translates along a pin axis that is parallel to and offset from the rocker shaft. The recess is centered on a recess axis that is parallel to and offset from the pin axis and the rocker shaft. The latch pin has a tapered head that narrows to a tip at a distal end of the latch pin. The recess has a tapered interior surface that narrows inwardly. The tapered head of the latch pin engages the tapered interior surface of the recess eccentrically with respect to the recess access. The head of the latch pin may engage the interior surface of the recess.

In other aspects or embodiments, the disclosure provides an engine brake in which the anti-clatter assembly includes a linkage mechanism including a spring in which the linkage mechanism effects a first spring force or a second spring force. The first spring force corresponds to the restraining force provided to the eccentric in the unbraked condition and the active state of the anti-clatter assembly. The second spring force corresponds to the yielding force provided to the eccentric in braked condition and the inactive state of the anti-clatter assembly.

The spring may be a torsion spring having legs that act on the linkage mechanism to provide the first spring force and the second spring force. The legs of the torsion spring being separated at a first deflection angle to provide the first spring force and at a second deflection angle to provide the second spring force. The first deflection angle is greater than the second deflection angle. The linkage mechanism may have two bars that are pivotally connected at a joint. The torsion spring is located at the joint and has one of the legs acting on one of the two bars and the other of the legs acting on the other of the two bars.

The spring may be an extension spring having one end connected to one of the two bars opposite the joint and having another end connected to the other of the two bars opposite the joint. The extension spring provides the first spring force corresponding to the restraining force provided to the eccentric in the unbraked condition and the active state of the anti-clatter assembly when the joint between the two bars is at a first side of the extension spring. The extension spring provides the second spring force corresponding to the yielding force provided to the eccentric in braked condition and the inactive state of the anti-clatter assembly when the joint between the two bars is at a second side of the extension spring that is opposite the first side.

In other aspects or embodiments, the disclosure provides an engine that includes an engine block having cylinders, a cam shaft arranged on the engine block and having cam lobes, a rocker shaft carrying rocker arms that are configured to engage the cam lobes of the cam shaft, and an engine brake mounted to the engine block. The engine brake includes an eccentric mounted to the rocker shaft and coupling one of the rocker arms to the rocker shaft to pivot eccentrically as the eccentric pivots about the rocker shaft. The eccentric takes a braked condition or an unbraked condition. An actuator is capable of pivoting the eccentric about the rocker shaft to move the eccentric from the unbraked condition to the braked condition. An anti-clatter assembly is movable from an active state associated with the unbraked position of the eccentric to an inactive state associated with the braked condition of the eccentric. The anti-clatter assembly provides to the eccentric a restraining force in the active state and no force or a force in the inactive state. The restraining force being greater than the yielding force. The restraining force is sufficient to impede the eccentric from pivoting about the rocker shaft in the unbraked condition. The yielding force is insufficient to impede pivoting of the eccentric in the braked condition. One or more of the aforementioned aspects or embodiments of the engine brake may be incorporated in the engine disclosed herein.

The details of one or more embodiments are set forth in the accompanying drawings and the description below. Other features and advantages will become apparent from the description, the drawings, and the claims.

BRIEF DESCRIPTION OF THE DRAWINGS

Like reference symbols in the various drawings indicate like elements.

DETAILED DESCRIPTION

Figure 1:
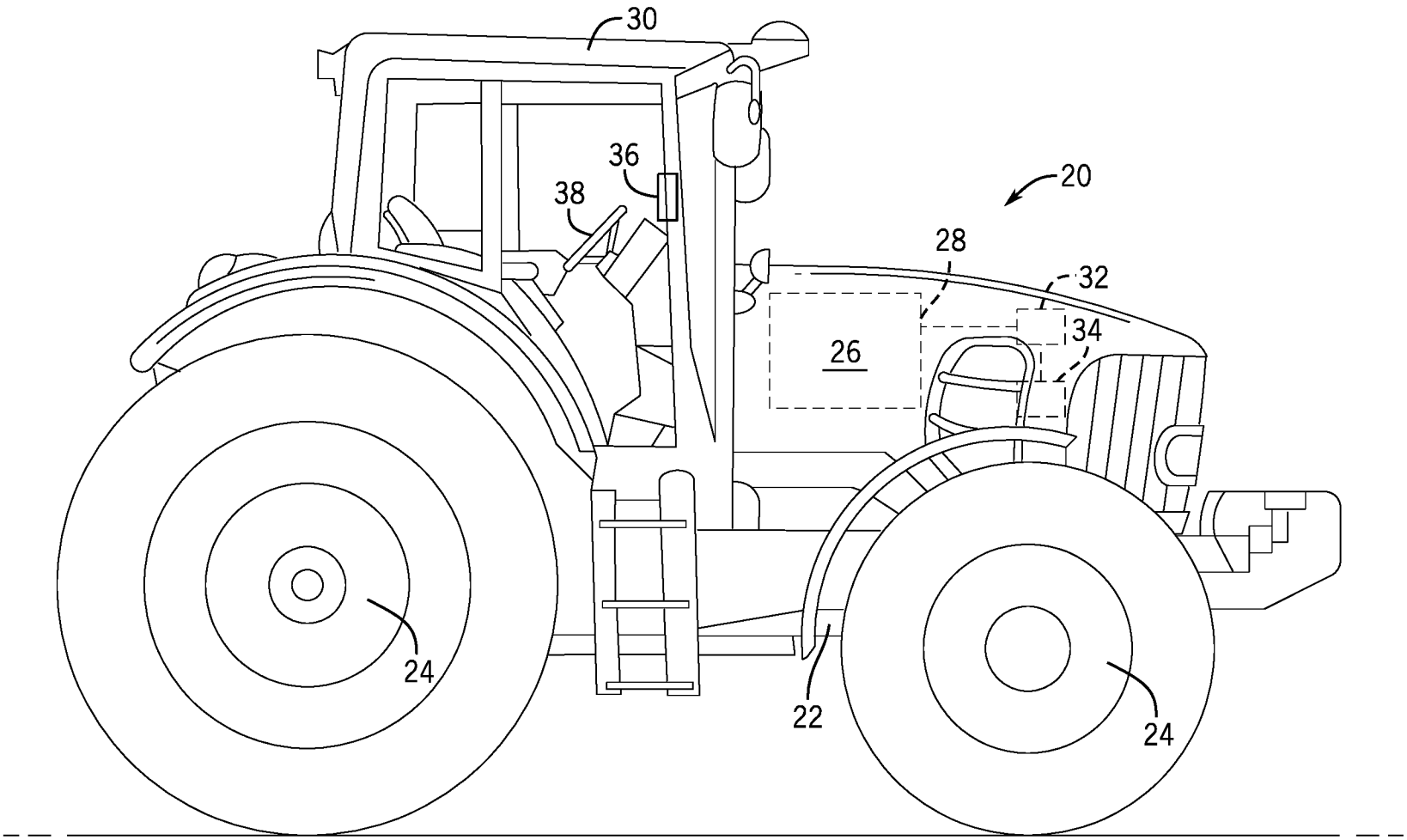
FIG. 1 is an example work vehicle in the form of an agricultural tractor in which the anti-clatter engine brake and engine of the present disclosure may be incorporated.

The following describes one or more example embodiments of the disclosed anti-clatter engine brake and engine, as shown in the accompanying figures of the drawings described briefly above. Various modifications to the example embodiments may be contemplated by one of skill in the art. Discussion herein focuses on the engine brake and engine being for a work vehicle, such as an agricultural tractor, but the engine brake and engine may be utilized in other contexts, including other work vehicle platforms in the agriculture, construction, forestry, mining, and other industries. Moreover, while the discussion herein focuses on clatter associated with an eccentric element of the engine brake, it is possible that the disclosed invention may be applicable to clatter associated with other components of the engine brake or the valvetrain.

Overview

Engine braking may be employed in heavy-duty work vehicles carrying heavy loads to dissipate kinetic energy with less utilization of dedicated braking components that may otherwise wear more quickly. Engine brakes of various types are known, including various hydraulically-actuated compression release engine brakes with hydraulic manifolds mounted within a valve block of the engine that serve to open a cylinder valve to decompress the cylinder and prevent a power stroke. In some cases, certain components of the engine brake or the valvetrain architecture may undergo unintended movements during operation of the engine and come into physical contact with other parts of the engine brake or valve train. The contacting components may cause noise, referred to herein as "clatter." Left unchecked, this can occur repetitively at a high frequency (e.g., greater than 1,000 times per minute) given the high rate of rotational or reciprocal motion (e.g., 3,000 or more RPM) of modern engines and valvetrains. Moreover, such clatter typically occurs when the engine brake is inactive, and thus, occurs during most, in some cases nearly all, of the time the engine is operated, thereby exacerbating the associated noise and fatigue problems.

It has been observed empirically that pivotal components, such as the eccentrics for rocker arms, may become unseated temporarily by an aberrant force, even against the bias of a return spring, and rapidly reseat after the aberrant force is removed. The origin of the phenomenon is unknown. One possibility is that stray or intermittent frictional forces may be imparted from the operation or movement of nearby components to unseat the clattering component. More likely, however, is that elastic forces may be induced in the eccentric from the equal and opposite forces associated with lifting of the valve (e.g., exhaust valve) during normal operation of the engine that, in turn, causes a transient responsive movement of the eccentric, which is then rapidly returned to its prior position.

This disclosure provides an engine brake, and engine having such an engine brake, that mitigates or prevents clatter of the type described above. In particular, the disclosure provides in the engine and engine brake an anti-clatter assembly in one or more forms that addresses aberrant movement of a component of the engine brake or valvetrain, which will be described herein with regard to the eccentric elements that operate to impart eccentric pivotal motion to the rocker arms about the rocker shaft. As noted above, it will be understood that the disclosed invention may be applicable to mitigate or prevent clatter of one or more other components of the engine brake or valvetrain. In each of the various forms, the anti-clatter assembly is movable from an active state associated with an unbraked position of the eccentric to an inactive state associated with a braked condition of the eccentric. The anti-clatter assembly provides to the eccentric a restraining force in the active state and no force or a yielding force in the inactive state with the restraining force being greater than the yielding force and while being sufficient to impede the eccentric from pivoting about the rocker shaft in the unbraked condition. The yielding force is insufficient to impede pivoting of the eccentric in the braked condition.

In some embodiments the anti-clatter assembly may include control components (e.g., valves), or coordinate with the work vehicle control system, to actively control the restraining force applied to the eccentric or other clattering component. However, in other embodiments, including those described herein, the anti-clatter assembly may operate entirely passively in the manner in which it generates the restraining force. In this context, the terms "active" and "passive" refer to the manner in which the restraining force is generated (i.e., controlled or uncontrolled), and should not be confused with the "active" and "inactive" (i.e., on or off) operational states of the anti-clatter assembly. In this way, the anti-clatter assembly may operate without dedicated control architecture (e.g., hydraulic switches or valves) to apply and adjust the restraining force. Rather, the anti-clatter assembly may apply and adjust the restraining force in proportion to engine oil pressure without otherwise being controlled. The anti-clatter assembly disclosed herein thus enhances engine operation without adding complexity to the engine control.

In one or more other aspects or embodiments, the disclosure provides an engine brake in which the anti-clatter assembly includes a latch pin configured to engage the eccentric to provide the restraining force in the active state. The engine brake may include an engine brake housing defining, at least in part, a hydraulic circuit and a pressure chamber in fluid communication with the hydraulic circuit. The latch pin is disposed in the pressure chamber and is driven by hydraulic pressure of the hydraulic circuit into the active position in which the latch pin physically abuts the eccentric to impede the eccentric from pivoting about the rocker shaft in the unbraked condition. The eccentric includes a recess into which the latch pin is disposed in part. The latch pin translates along a pin axis that is parallel to and offset from the rocker shaft. The recess is centered on a recess axis that is parallel to and offset from the pin axis and the rocker shaft. The latch pin has a tapered head that narrows to a tip at a distal end of the latch pin. The recess has a tapered interior surface that narrows inwardly. The tapered head of the latch pin engages the tapered interior surface of the recess eccentrically with respect to the recess access. The head of the latch pin engages the interior surface of the recess in a reduced contact region.

In other aspects or embodiments, the disclosure provides an engine brake in which the anti-clatter assembly is or includes a spring and linkage mechanism that effects a first spring force or a second spring force. The first spring force corresponds to the restraining force provided to the eccentric in the unbraked condition and the active state of the anti-clatter assembly. The second spring force corresponds to the yielding force provided to the eccentric in braked condition and the inactive state of the anti-clatter assembly.

The spring may be a torsion spring having legs that act on the linkage mechanism to provide the first spring force and the second spring force. The legs of the torsion spring are separated at a first deflection angle to provide the first spring force and at a second deflection angle to provide the second spring force. The first deflection angle is greater than the second deflection angle. The linkage mechanism may have two bars that are pivotally connected at a joint. The torsion spring is located at the joint and has one of the legs acting on one of the two bars and the other of the legs acting on the other of the two bars. The spring rate of the torsion spring reduces with decreasing deflection angle such that the higher restraining force is provided in the active state of the spring and linkage mechanism during normal engine operation and the lower yielding force is provided in the inactive state during engine braking.

The spring may be an extension spring having one end connected to one of the two bars opposite the joint and having another end connected to the other of the two bars opposite the joint. The extension spring provides the first spring force corresponding to the restraining force provided to the eccentric in the unbraked condition and the active state of the anti-clatter assembly when the joint between the two bars is at a first side of the extension spring. The extension spring provides the second spring force corresponding to the yielding force provided to the eccentric in braked condition and the inactive state of the anti-clatter assembly when the joint between the two bars is at a second side of the extension spring that is opposite the first side. As such, the spring and linkage mechanism provides the higher restraining force when the extension springs are extended more fully and located to the outer side of the pivot joint opposite the eccentric and provides the yielding force when the extension springs are extended less and the pivot joint is located to the outer side of the extension springs opposite the eccentric. Here, the yielding force reverses when the pivot joint moves past the extension springs (i.e., is thus an "over-center" type mechanism) and provides an assist force that aids in the pivoting of the eccentric to activate engine braking but still allows the eccentric to pivot back to its initial position corresponding to normal engine operation.

These and other aspects of the disclosed engine brake and engine will be better understood with regard to the example that will now be described.

Example Anti-Clatter Engine Brake and Engine

Referring to FIG. 1, a work vehicle 20 may be implemented as an agricultural tractor or any other heavy-duty work vehicle such as those used in the agricultural, construction, forestry and mining industries. The work vehicle 20 includes a chassis 22 mounting a plurality of ground-engaging members 24, such as wheels or tracks, supporting the chassis 22 off the ground. Supported on the chassis 22 is an engine compartment 26 housing an engine 28 and an operator cabin 30 to be occupied by an operator of the work vehicle 20. It should be understood that the present disclosure may also pertain to autonomous work vehicles, in which case the operator cabin may be omitted.

The engine 28 may be an internal combustion engine, such as a diesel engine, suitable for providing tractive and operational power to the work vehicle 20. In the disclosed implementations, the example engine 28 has six cylinders arranged in a line. Generally, the engine 28 supplies power to the work vehicle 20 either alone or as part of a hybrid power system in which power from the engine 28 is supplemented or replaced during certain operational modes by one or more electric machines, fuel cells or other power sources. As is conventional, and not illustrated in the drawings, each engine cylinder includes a piston and a connecting rod. Each piston reciprocates within the cylinder between a top dead center positioned and a bottom dead center to reduce or enlarge the effective size of a combustion chamber within each cylinder. In the example implementations shown and described herein the engine 28 is a four-stroke, inline, single camshaft, six-cylinder compression ignition engine with a conventional intake stroke, compression stroke, expansion or power stroke, and exhaust stroke in succession.

In addition to providing tractive power to propel the work vehicle 20, the engine 28 may provide power to various onboard subsystems, including various electrical and hydraulic components of the work vehicle 20, and for off-boarding power to other sub-systems remote from the work vehicle 20. For example, the engine 28 may provide mechanical power that is converted to an electric format to run electronics of a control system 32 and electric drives of the work vehicle 20. The engine 28 may also provide mechanical power that is converted to hydraulic format to power various pumps and compressors that pressurize fluid to drive various actuators of a hydraulic system 34 in order to power wheel steering and various work implements onboard the work vehicle 20. The hydraulic system 34 may include other components (e.g., valves, flow lines, pistons/cylinders, seals/gaskets, and so on), such that control of various devices may be effected with, and based upon, hydraulic, mechanical, or other signals and movements.

The control system 32 may be configured as a computing device with associated processor devices and memory architectures, as a hard-wired computing circuit (or circuits), as a programmable circuit, as a hydraulic, electrical, or electro-hydraulic controller. The control system 32 may be configured to execute various computational and control functionality with respect to the work vehicle 20, including various devices associated with the engine 28, the hydraulic system 34, and various additional components of the work vehicle 20 (e.g., the engine brake and valvetrain). In some embodiments, the control system 32 may be configured to receive input signals in various formats (e.g., as hydraulic signals, voltage signals, current signals, and so on), and to output command signals in various formats (e.g., as hydraulic signals, voltage signals, current signals, mechanical movements, and so on). The control system 32 may include any practical number of processors, control computers, computer-readable memories, power supplies, storage devices, interface cards, and other standardized components, and may also include or cooperate with any number of firmware and software programs or computer-readable instructions designed to carry-out the various process tasks, calculations, and control/display functions. Such computer-readable instructions may be stored within a non-volatile sector of a local onboard memory, which is accessible to the processor. The memory can encompass any number and type of storage media suitable for storing computer-readable code or instructions, as well as other data utilized to support the operation of the work vehicle 20. The memory may be integrated into the controller architecture in various embodiments such as, for example, a system-in-package, a system-on-a-chip, or another type of microelectronic package or module.

The operator cabin 30 may include one or more display devices 36 and any of various operator interfaces 38 coupled to the control system 32. Apart from the display devices 36, the operator interface devices 38 may include various video and audio devices for providing video and audio information, haptic devices that provide tactile feedback, levers, joysticks, steering wheels, pedals, buttons, and so on. The work vehicle 20 may include various onboard sensors and actuators and a network interface. The onboard sensors can include various different types of sensor architectures for providing the processor with input pertaining to the operational parameters of the work vehicle 20, data pertaining to the surrounding environment of the work vehicle 20, and other such information useful to operation of the work vehicle 20.

Figure 2:
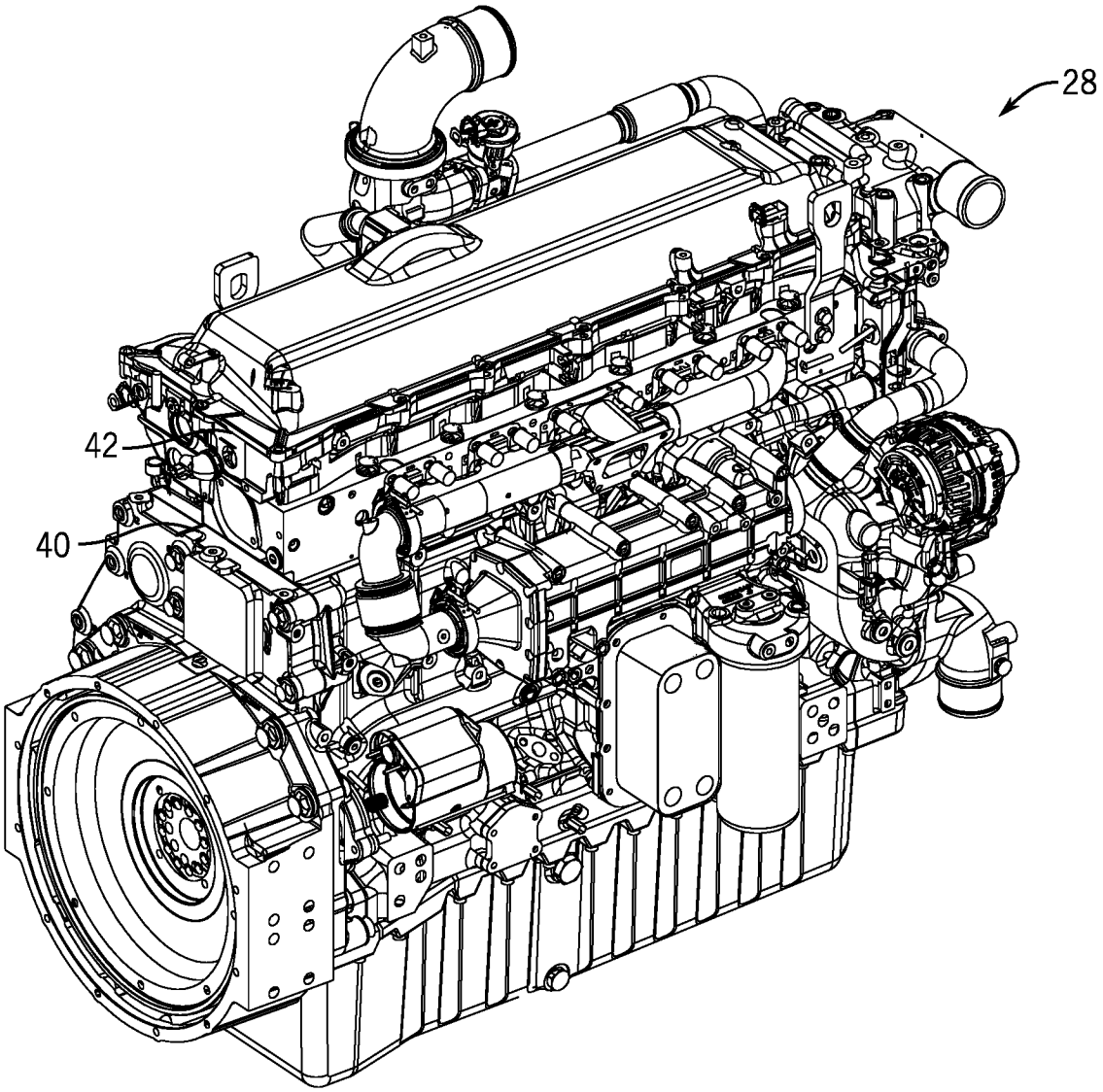
FIG. 2 is a perspective view of an example engine thereof having an anti-clatter engine brake according to the present disclosure.
Figure 3:
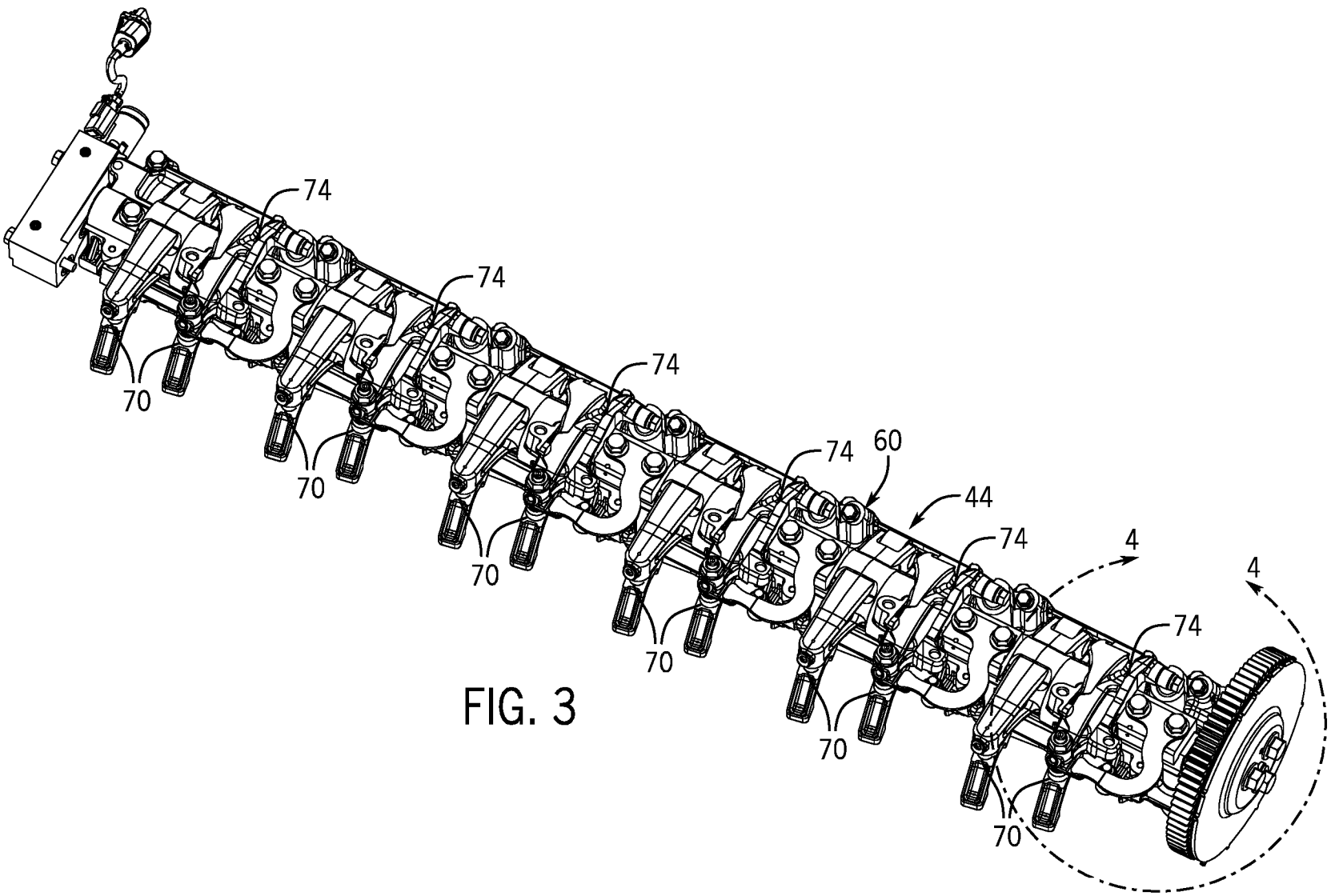
FIG. 3 is a perspective view of a valve train thereof having an example an anti-clatter engine brake according to the present disclosure.

Referring also to FIGS. 2 and 3, the engine 28 includes a crankcase 40, a valve block 42 having a valve train 44 and mounted on the crankcase 40 to at least partially enclose engine cylinders (not shown) defined by the crankcase 40, and a crank shaft (not shown) rotatably coupled to the crankcase 40 and connected to the pistons by crank arms and connecting rods (not shown). The reciprocating motion of the pistons within the cylinders rotates the crankshaft to output power to the work vehicle 20. The engine 28 is operable in a positive power condition in which the engine 28 drives the crankshaft to rotate (e.g., applies torque to the crankshaft in one clock direction), and a negative power condition, in which the engine resists the rotation of the crankshaft and acts as a brake (e.g., applies torque to the crankshaft in an opposite clock direction). The positive power condition of the engine generally corresponds with combustion cycle operation, while the negative power condition generally corresponds with compression release engine braking operation.

The valve train 44 is configured to selectively open and close pairs of intake and exhaust cylinder valves (not shown) in communication with each engine cylinder. The valve block 42 defines corresponding intake and exhaust openings with valve seats (not shown) extending between and in fluid communication with respective intake and exhaust manifolds (not shown) and each engine cylinder. The valvetrain 44 has a camshaft 48 having intake and exhaust cam lobes 50. The cam lobes 50 may be formed by eccentric features, ramps, or various other cam surface profiles of the camshaft 48. The profiles, the clock position, or both, of the intake and exhaust cam lobes 50 are spaced apart axially along the camshaft 48 and are in different angular orientations such that as the camshaft 48 is rotated the cam lobes 50 contact and drive valve actuators to seat and unseat the cylinder valves at different times. The valve actuators may be various follower mechanisms, such as rocker arms 70 that are mounted to a rocker shaft 72 by eccentrics 74. The rocker shaft 72 is mounted to the valve block 42 in a fixed position, and the rocker arms 70 pivot on the eccentrics 74 the about the rocker shaft 72 so that the distal ends of the rocker arms 70 carrying valve stems/lift rods (not shown) follow an eccentric path as they valves are seated and unseated at the proper time during the combustion cycle. More specifically, each valve includes one of the valve stems/lift rods with a spring retainer (not shown) proximate an upper tip thereof and a valve head (not shown) at a lower end thereof. A spring (not shown) is positioned around the valve stem/lift rod in engagement with the spring retainer. The valve heads are configured to seat against the corresponding seats of the associated cylinder. Rollers 76 at the opposite ends of the rocker arms 70 come in contact with and follow the cam lobes 50 intermittently during various portions of the combustion cycle that effect and affect the pivotal movement of the rocker arms 70 and thereby the seating and unseating of the valves. This pivotal movement of the rocker arms 70 and the seating and unseating of the valves occurs rapidly in repetition at precise times of the combustion cycle and varies in rate depending on the commanded engine speed and whether the engine is operating in a braked condition or an unbraked condition.

In normal operation of the engine 28, the camshaft 48 rotates and the cam lobes 50 engage with the rollers 76 on the rocker arms 70 that are associated with the intake valves, which are thereby lifted from their seats. The cam lobes 50 do not cause the rocker arms 70 associated with the exhaust valves to pivot at this rotational position of the camshaft 48 such that the exhaust valves remain seated. During the intake stroke, the pistons are moved downward creating a partial vacuum that draws a fuel/air mixture (or air alone) through the intake valve openings and into the combustion chambers. Once the camshaft 48 rotates such that the cam lobes 50 no longer engage with the rollers 76 on the intake rocker arms 70 sufficiently to effect pivoting, the springs cause the intake valves to move upward and reseat onto their seats. During the compression stroke, the fuel/air mixture (or air alone) is compressed to the top of the combustion chambers by the pistons moving upward, thereby reducing the volume of the combustion chambers. Towards the end of this movement, near top dead center, fuel is injected (if only air was present previously) and the fuel/air mixture is ignited, by a spark plug or by compressive self-ignition. When the ignited air/fuel mixture expands, the pistons are pushed downwards, and this causes the expansion or power stroke that creates the engine power. The camshaft 48 is in an angular orientation such that the cam lobes 50 are not in contact with the rollers 76 so as to not pivot the rocker arms 70 or lift the valves during the combustion stroke. During the exhaust stroke, the camshaft 48 is in an angular orientation in which the cam lobes 50 engage with the rollers 76 associated with the exhaust valves, which are lifted from their seats. During the exhaust stroke, the pistons are moved upward, forcing the gases that were created during the expansion or power stroke out of the combustion chambers through the exhaust valve openings after which the exhaust cam lobes 50 are rotated until they no longer engage with the rollers 76 so that the springs reseat the exhaust valves. The four-stroke cycle then repeats continuously during normal engine operation.

The engine brake assembly 60 may include one or more discrete assemblies designed to effect engine braking collectively in all or a subset of the engine cylinders. For example, there may in a six-cylinder engine, as described herein, there may be one, two, or three engine brake assemblies arranged within the valve block 42, serving all six, two sets of three, or three pairs of the cylinders. As each engine brake assembly may have a similar or identical configuration, only one engine brake assembly will be detailed herein with respect to one eccentric 74. Moreover, while other types of engine brakes are contemplated, in the example implementations described herein, the engine brake assemblies 60 are activated selectively to cause a compression release event between or during parts of the compression stroke and the expansion or power stroke.

The engine brake assembly 60 includes the cam lobes 50 associated with the exhaust valves, and thus may be considered "brake" lobes. A brake housing 80 is mounted within the valve block 42 which defines, at least in part, an internal hydraulic circuit 82 coupled to a hydraulic fluid source (e.g., to an engine oil circuit pressurized by an engine oil pump, not shown, at least in part routed through internal passages of the valve block 42). An actuator piston 84 disposed within a piston chamber 86 defined by the brake housing 80 and in communication with the hydraulic circuit 82.

The engine brake assembly 60 is activated under control of the control system based on input from various vehicle sensors or the vehicle operator and memory-stored engine braking control algorithms. Under control of the control system 32, one or more valves (e.g., solenoid valves, not shown) may be opened and closed to allow hydraulic fluid (e.g., engine oil) to flow into the brake housing 80 and create high-pressure within the piston chamber 86. In this way, the actuator piston 84 may be selectively controlled to extend and retract and thereby control the angular position or lift profile of the eccentrics 74 about the rocker shaft 72 going from a normal lift profile to a higher engine brake profile, and in so doing, controlling the unbraked and braked conditions of the engine 28 and the engine brake assembly 60.

Figure 4A:
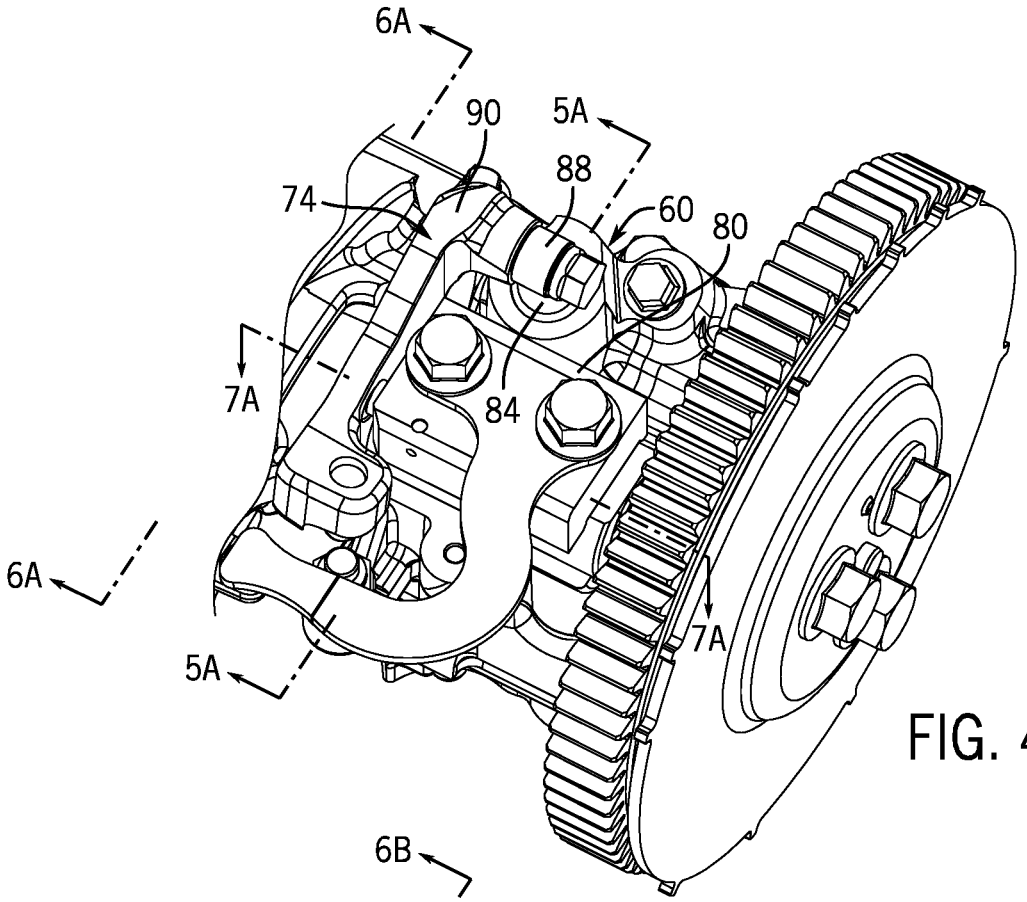
FIGS. 4A and 4B are an enlarged partial perspective views of area 4-4 of FIG. 3 with the engine brake in respective unbraked and braked conditions.
Figure 4B:
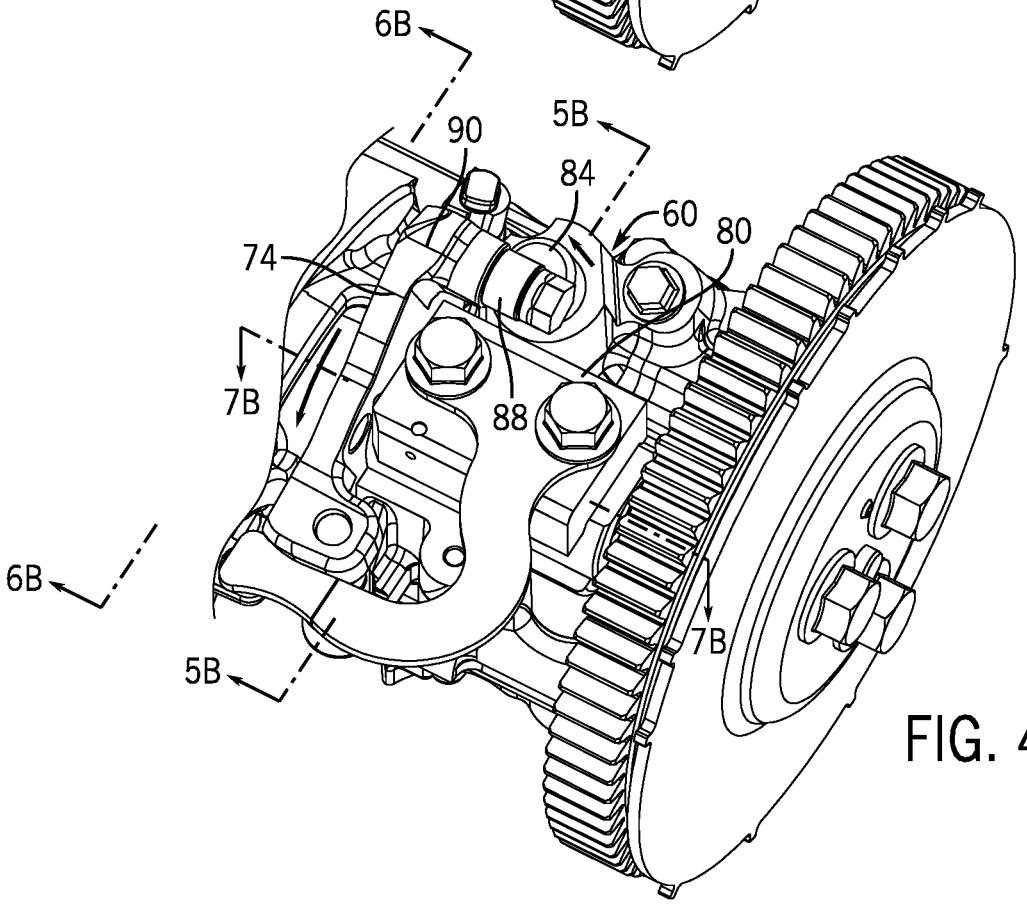
Figure 5A:
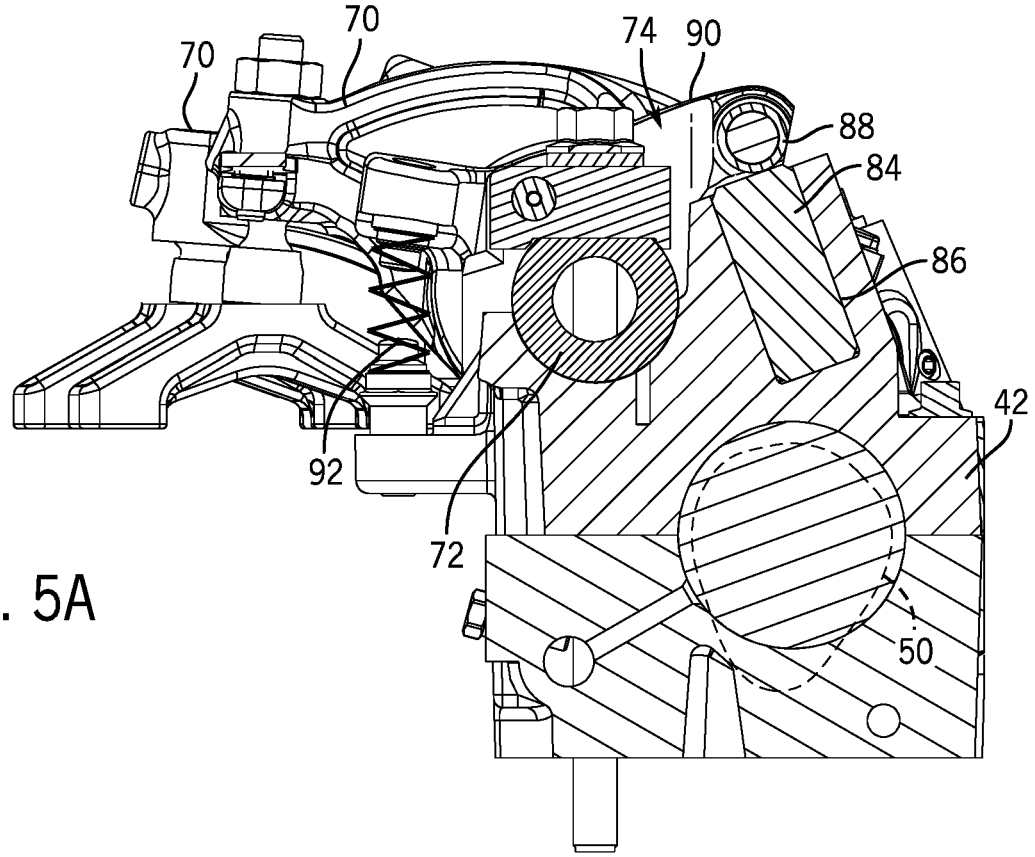
FIGS. 5A and 5B are enlarged section views taken along lines 5A-5A of FIGS. 4A and 5B-5B of FIG. 4B showing an eccentric element pivoted in different positions about a rocker shaft corresponding to the respective unbraked and braked conditions.
Figure 5B:
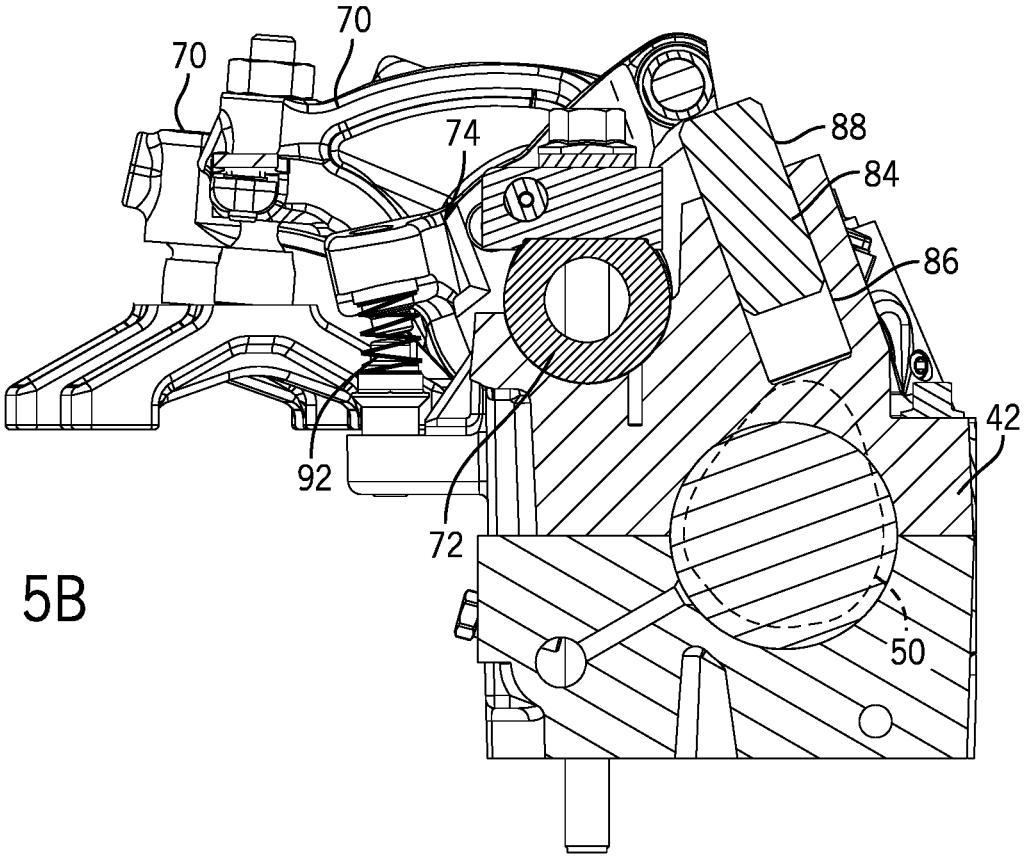
Figure 6A:
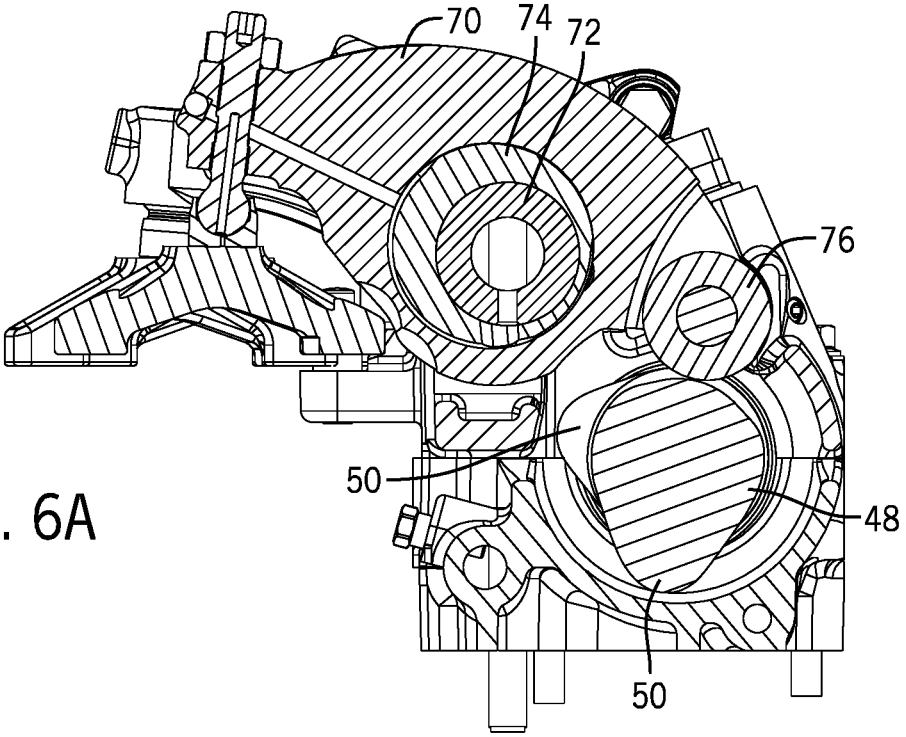
FIGS. 6A and 6B are enlarged section views taken along lines 6A-6A of FIGS. 4A and 6B-6B of FIG. 4B showing a rocker arm pivoted in different positions about the rocker shaft corresponding to the respective unbraked and braked conditions.
Figure 6B:
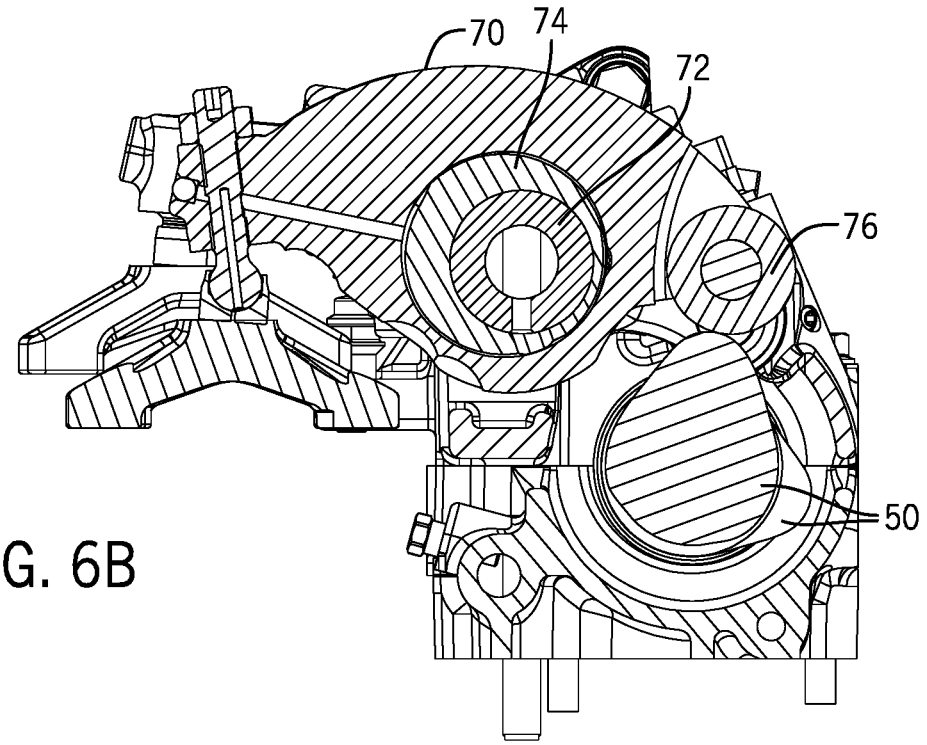
Figure 7A:
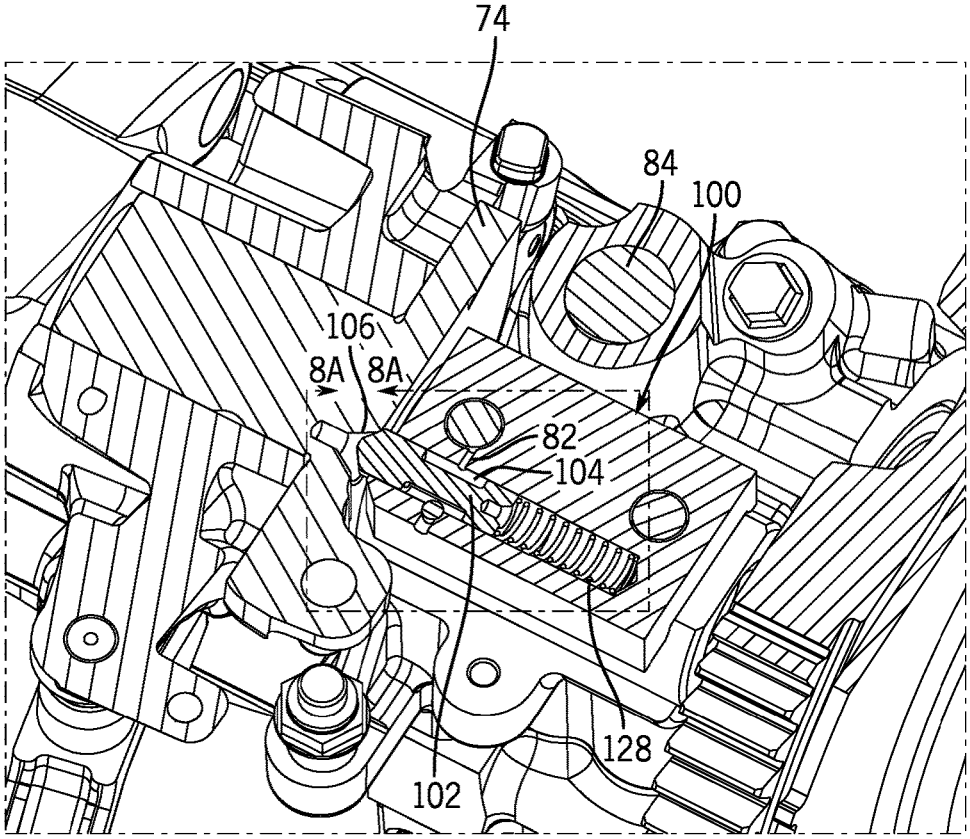
FIGS. 7A and 7B are enlarged section views take along lines 7A-7A of FIGS. 4A and 7B-7B of FIG. 4B showing an example anti-clatter assembly in respective active and inactive states.
Figure 7B:
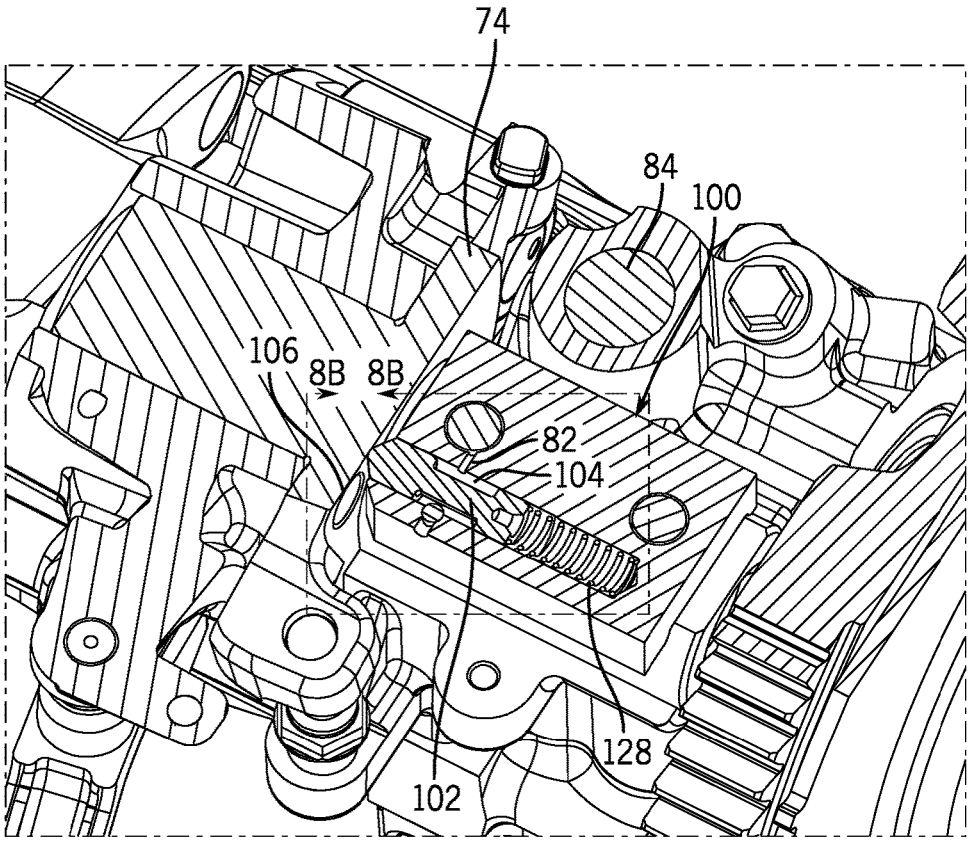
Figure 8A:
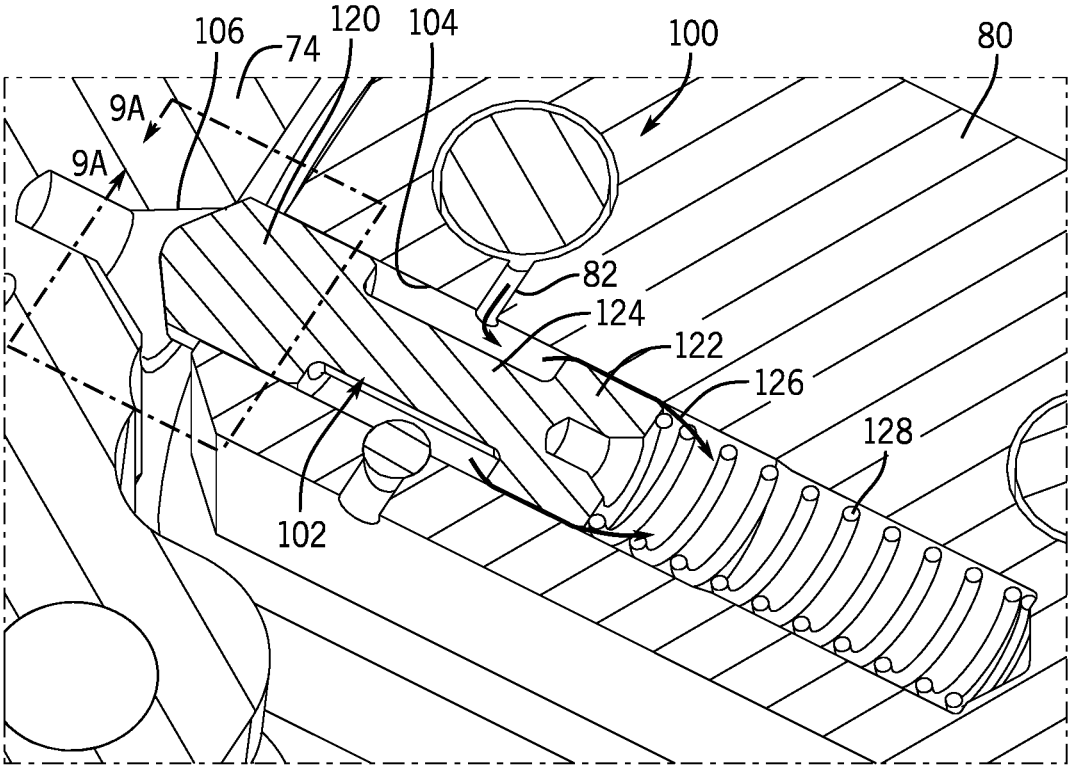
FIGS. 8A and 8B are enlarged sectional detail views of areas 8A-8A of FIGS. 7A and 8B-8B of FIG. 7B.
Figure 8B:
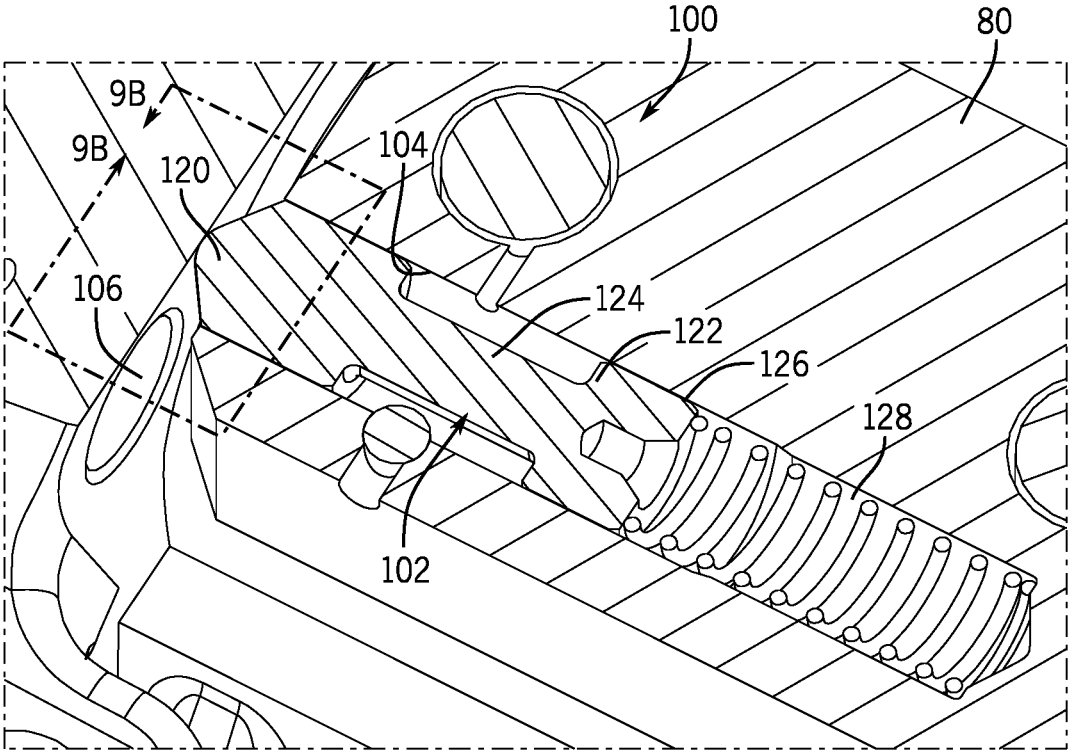
Figure 9A:
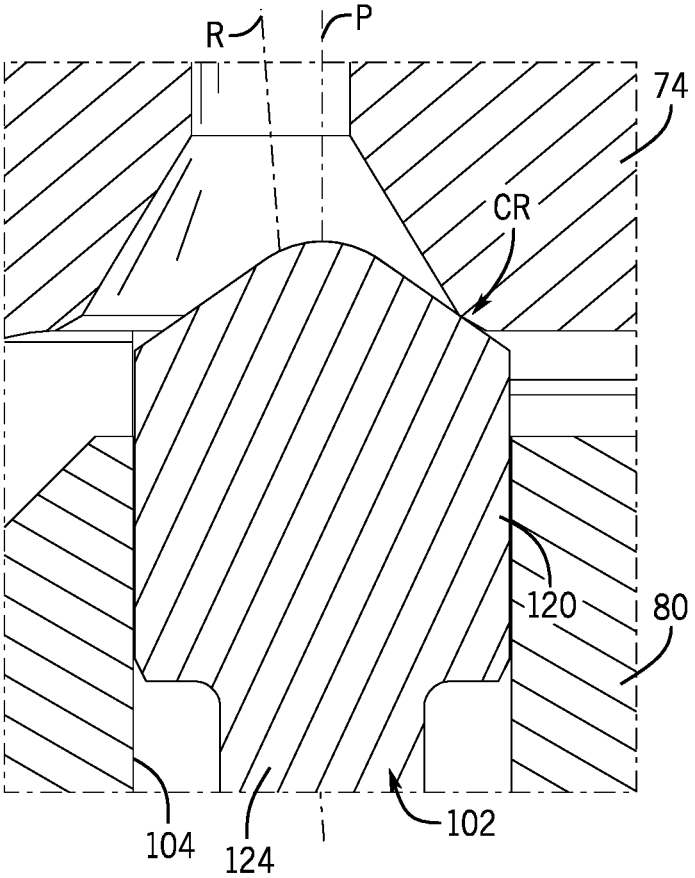
FIGS. 9A and 9B are enlarged sectional detail views of areas 9A-9A of FIGS. 8A and 9B-9B of FIG. 8B.
Figure 9B:
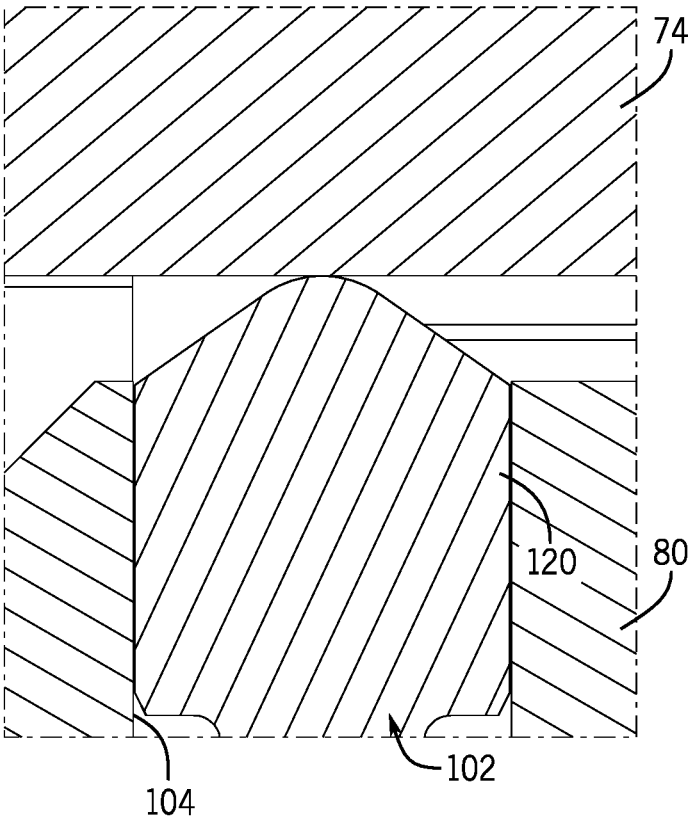

More specifically, the actuator piston 84 is movable within the piston chamber from the position shown in FIGS. 4A and 5A to that shown in FIGS. 4B and 5B. In the FIGS. 4B and 5B orientation or lift profile corresponding to an engine braking condition, an end of the actuator piston 84 extends from the brake housing 80. The piston end is in contact with a glide or roller 88 at an activation arm 90 of the associated eccentric 74. A return spring 92 (e.g., a compression spring) is coupled to the eccentric 74 at a side of the eccentric 74 opposite the activation arm 90 that biases the eccentric toward the unbraked normal lift profile and biases the activation arm 90 in contact with the actuator piston 84. Extension of the actuator piston 84 from the piston chamber 86 overcomes the spring force of the return spring 92 of the associated eccentric 74, which causes the eccentric 74 to pivot about the rocker shaft 72. Due to its asymmetric configuration, the eccentric 74 repositions the angular orientation of the associated rocker arm 70, from the orientation corresponding to the normal lift profile shown in FIG. 5A to the orientation corresponding to the brake lift profile shown in FIG. 6B, such that during engagement with the associated exhaust cam lobe 50, a braked condition is effected by a compression release event in the associated engine cylinder. The control system 32 may control suitable valving to vent the pressure from the piston chamber 86 and allow the actuator piston 84 to retract such that reverse pivoting and return of the associated eccentric 74 is effected. The rocker arm 70 may be returned mechanically to its normal angular orientation (e.g., by return spring force). This action returns the engine 28 and the engine brake assembly 60 to its unbraked condition such that normal engine operation may resume. The eccentric 74 is in the orientation of FIGS. 4B and 5B during engine braking, and then allowed to return to the orientation of FIGS. 4A and 5A during normal unbraked engine operation. However, as noted above, aberrational movement of the eccentric 74 has been found to occur causing clatter, and associated fatigue and possible part failure, which is addressed as will now be described.

Referring now also to FIGS. 7A-9B, one example anti-clatter assembly 100 is a hydraulic pin mechanism including a latch pin 102 that is moveable within a pressure chamber 104 along a pin axis P into and out of engagement with a recessed pocket 106 in the associated eccentric 74. An identical anti-clatter assembly 100 may be utilized for each eccentric 74. The anti-clatter assembly 100 has the characteristics of providing a strong engagement force to secure the eccentric 74 against pivotal movement during normal unbraked operation of the engine 28, and a reduced engagement force during engine braking so that the eccentrics 74 can be pivoted readily to and from the braked angular orientation by the actuator pistons 84.

More specifically, the pressure chamber 104 is formed in the brake housing 80 in communication with the hydraulic circuit 82. It should be noted that in other implementations the anti-clatter assembly 100 may be housed separately and operated by a dedicated hydraulic circuit. In the example implementations described herein, hydraulic pressure (e.g., engine oil) forces the latch pin 102 to extend along the pin axis P out from the pressure chamber 104 into engagement with the eccentric 74. The return spring 92 of the eccentric 74 positions the eccentric 74 into its normal, unbraked angular orientation, in which the recessed pocket 106 of the eccentric 74 is in position to be engaged by the latch pin 102. As will be described, the pivotal motion of the eccentric 74 moves the latch pin 102 to recede back along the pin axis P out of the recessed pocket 106 without significantly impeding the pivotal motion of the eccentric 74 when moving into, during, and when moving from, the braked condition of the engine 28.

In the example implementations, the latch pin 102 has a bullet-shape with a head 120 and tail 122 and a narrowed body 124. The head 120 and tail 122 generally have the same outer diameter dimension which is within close tolerances of the inner diameter of the pressure chamber 104 such that a narrow annular gap 126 exists radially between the tail 122 of the latch pin 102 and the inner diametral wall of the pressure chamber 104. The inner end of the pressure chamber 104 is dead-ended and closed off. Hydraulic fluid enters the pressure chamber 104 via an orifice located between the head 120 and tail 122 of the latch pin 102. This area around the body 124 of the latch pin 102 fills with fluid rapidly, and as pressure increases, the fluid flows into and through the annular gap 126 until the pressure on axial each side of the tail 122 reaches equilibrium. With fluid within the pressure chamber 104, The latch pin 102 acts as a dashpot supplying viscosity-based forces from the latch pin 102 to the eccentric 74 that are proportional to the velocity at which the latch pin 102 translates along the pin axis P. The latch pin 102 supplies a high restraining force on the eccentric 74 at higher velocity, such as in response to the rapid movement of the eccentric 74 in the unbraked condition that gives rise to the aberrational clatter, since the fluid escapes through the annular gap 126 slower than the rapid movement causing the clatter. Conversely, the latch pin 102 provides a relatively low yielding force, which may even be insignificant to inhibit the movement of the eccentric 74 by the actuator piston 84 and thereby translation of the latch pin 102, which is much slower movement compared to the clatter-causing movement, when the actuator piston 84 pivots the eccentric 74 into the orientation corresponding to the brake lift profile. It should be noted that the anti-clatter assembly 100 may be configured so that the latch pin 102 withdraws sufficiently so that it is out of contact with the eccentric 74, thereby providing no force to the eccentric 74.

In the example implementations, a spring 128 is disposed within the pressure chamber 104 between the tail 122 and the dead end. The spring 128 may provide passive, mechanical activation of the latch pin 102 in the event of low fluid pressures. The spring rate or spring working load may be selected to be relatively low (e.g., a spring rate of 2 N/mm or a spring working load of 25N) with the spring force combined with the hydraulic pressure forces acting on the latch pin 102 being balanced under normal hydraulic pressures.

In the example implementations, the hydraulic circuit 82 and the hydraulic fluid used in the anti-clatter assembly 100 may be engine oil, which is a relative low pressure (e.g., 25-65 psi) hydraulic fluid. As noted, the anti-clatter assembly 100 disclosed herein may operate passively in which the restraining force is applied and adjusted by the engine oil pressure without separate active control hardware. Of course, engine oil pressure fluctuates during operation of the work vehicle 20, such as during low engine speeds or high loads when power demands may limit power to the oil pump. Furthermore, the same hydraulic circuit 82 and hydraulic fluid may control the actuator piston 84 and thereby the lift profile orientation of the eccentric 74. During such periods of low pressure, the actuator piston 84 has reduced capacity to pivot the eccentric 74. This is accommodated by the anti-clatter assembly 100, which provides decreased static resistance during low pressure conditions. This allows the anti-clatter assembly 100 to provide high latching force when oil pressure is normal or high yet be overcome readily by the actuator piston 84 to position the eccentric 74 even during low pressures, when the activating forces of the actuator piston 84 are the lowest.

The anti-clatter assembly 100 has additional aspects that aid in effectively holding the eccentric 74 from clattering during normal unbraked engine operation without impeding engine braking activation or deactivation. These include the configuration, alignment, contact region, and cam action of the head 120 of the latch pin 102 vis-à-vis the recessed pocket 106 in the eccentric 74. In particular, the head 120 of the latch pin 102 has a tapered contour defining an exterior periphery that is generally a conical section terminating in a rounded tip. The recessed pocket 106 has an interior surface that is also generally a conical section, such as may be formed by a conventional countersinking milling bit or a lathe center drill. The included angles of the two conical sections differ, such as with that of the recessed pocket 106 being narrower, defining an acute angle in one example, than that of the head 120, which defines an obtuse angle in one example. Moreover, the recessed pocket 106 is centered on a recess axis R that is generally parallel and offset with respect to the pin axis P along which the latch pin 102 translates when the eccentric 74 is in the normal lift and unbraked orientation. Furthermore, the translation of the latch pin 102 is selected so that it protrudes only partially into the recessed pocket 106, extending only a factional portion of its stroke length, which in the example implementations is about 1-3 mm of about a 12-15 mm stroke. These aspects, namely the shapes and relative differences of the conical sections, the misalignment of the axes, and the translation extension, prohibits the latch pin 102 from seating fully into the recessed pocket 106, permitting only a comparatively small contact region CR between the latch pin 102 and the eccentric 74 in the unbraked condition. The contact region CR is significantly less than the area of the exterior and interior peripheral (e.g., conical) sections of the latch pin head 120 and the recessed pocket 106, and, because of the offset axes, the contract region CR does not extend around the perimeter or circumference of the head 120 but is limited to a finite arcuate area spanning an arc of less than five degrees centered on the pin axis P. In some cases, the contract region CR may even be limited to line or point contact. This arrangement provides some overtravel of the sloped contact surfaces while preventing the head 120 of the latch pin 102 from bottoming out in the recessed pocket 106. If the anti-clatter assembly 100 was configured to allow the head 120 of the latch pin 102 to bottom out within the recessed pocket 106, variations in part tolerances may result in small gaps to be formed between the actuator piston 84 and the eccentric 74, thereby allowing some clattering to remain, which is avoided with the configuration disclosed herein.

The latch pin 102 is removed passively from the recessed pocket 106 by the force acting to pivot the rocker arm 70. No dedicated or other active retraction force is required or provided by the anti-clatter assembly 100. However, a cam action facilitates the rapid retraction of the latch pin 102 as the eccentric 74 is pivoted by the actuator piston 84 to activate engine braking. At that point, the latch pin 102 is removed from the recessed pocket 106 and the small tip rides along a flat surface of the eccentric 74 as the return spring 92 reorients the eccentric 74 following retraction of the actuator piston 84. While the anti-clatter assembly 100 allows for rapid disengagement of the latch pin 102 from the recessed pocket 106, during the active state of the anti-clatter assembly 100 under the normal unbraked condition, the engagement of the latch pin 102 with the recessed pocket 106 at the contact angles of the conical sections create a frictional component that multiplies the effective holding force of the latch pin 102 by resisting retraction of the latch pin 102 and increasing the force to disengage from the recessed pocket 106 without binding. The self-multiplying friction allows a weaker axial force sum to be amplified to provide higher restraining force. This, in turn, allows for an overall reduction in sizing, such as the pin diameter, pressure chamber and hydraulic fluid volume, and spring rate. All of this allows the anti-clatter assembly 100 to securely arrest aberrational clattering of the eccentric 74 during unbraked normal engine operation without impeding the activation and deactivation of engine braking, thus improving the transient response of the engine braking.

Figure 10A:
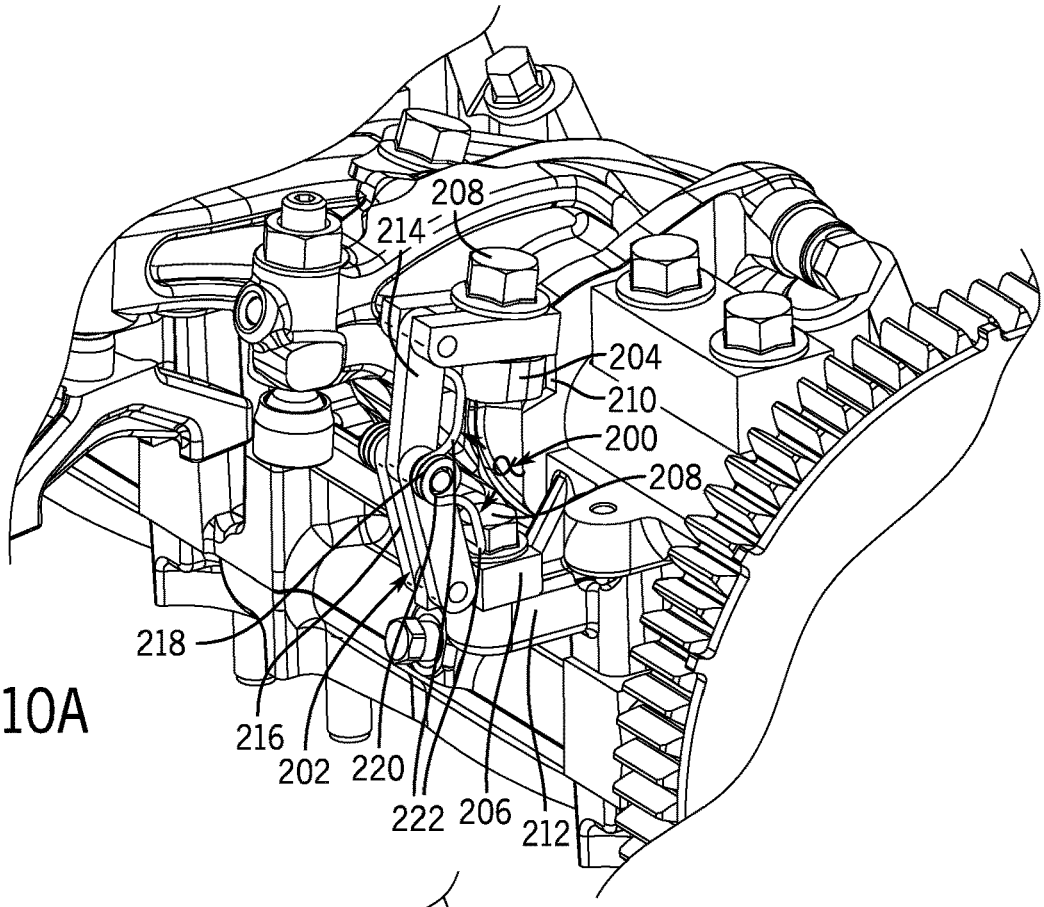
FIGS. 10A and 10B are partial perspective views showing an alternate example engine brake with another example anti-clatter assembly in respective active and inactive states.
Figure 10B:
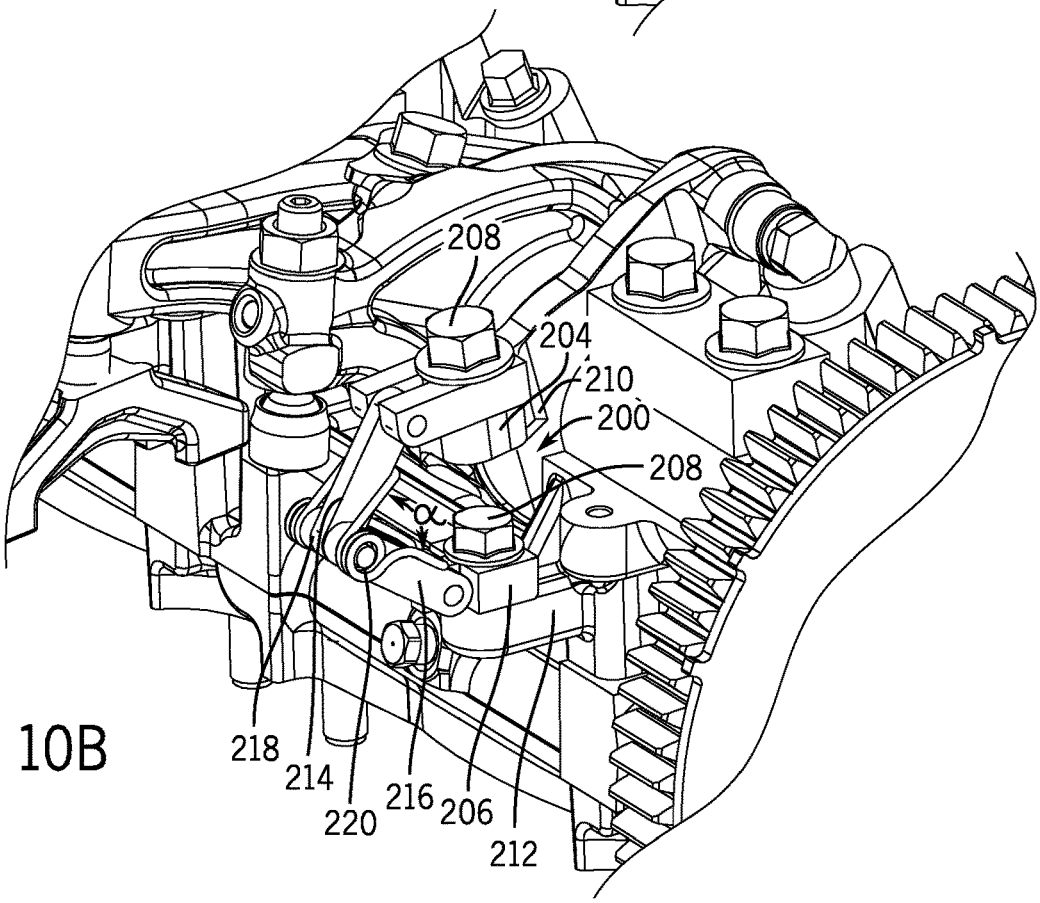

Referring now to FIGS. 10A and 10B, another example anti-clatter assembly will now be described in which the anti-clatter assembly 200 is a spring and linkage mechanism. Generally, the anti-clatter assembly 200 replaces the return spring 92 described above and serves the dual functions of providing a high restraining force biasing the activation arm 90 against the actuator piston 84 during normal unbraked engine operation and a low yielding force during engine braking and the activation and deactivation thereof.

Specifically, the linkage 202 is coupled to the eccentric 74 and fixed to the engine 28, such as at the valve block 42 (or alternatively the engine brake housing 80) by pivot mounts 204, 206, which include bolts 208 that thread into corresponding threaded openings. The pivot mount 204 is located in a notched area 210 of the eccentric 74 and travels with the pivotal motion of the eccentric 74. The pivot mount 206 is located at an extension flange 212 of the valve block 42. Two bars 214 and 216 of the linkage 202 are coupled together at a movable pivot joint 218. In the example implementations, the bar 216 is formed by a pair of bars with their upper ends coupled to the lower end of the bar 214 at opposite sides of the bar 214. The opposite ends of the bars 214, 216 are pivotally coupled to the pivot mounts 204, 206, respectively.

A torsion spring 220 is mounted at the pivot joint 218 with its extension legs 222 abutting, under compression of the spring force, edges of the bars 214, 216 that face the eccentric 74. In the active state of the anti-clatter assembly 200 shown in FIG. 10A in which the anti-clatter assembly 200 is functioning to resist clatter during normal unbraked operation of the engine 28, the included deflection angle $\alpha$ between the extension legs 222 (similarly the pivot angle between the bars 214, 216) is larger than in the inactive state of the anti-clatter assembly 200 shown in FIG. 10B during engine braking. Since the spring rate of the torsion spring 220 is higher at larger deflection angles, the torsion spring 220, via deflection of the extension legs 222 acting on the bars 214, 216 of the linkage mechanism 202, provides the high restraining force in the active state of the anti-clatter assembly 200 shown in FIG. 10A and the low yielding force in the inactive state of the anti-clatter assembly 200 shown in FIG. 10B. This allows the anti-clatter assembly 200 to securely arrest aberrational clattering of the eccentric 74 during unbraked normal engine operation without impeding the activation and deactivation of engine braking.

Figure 11A:
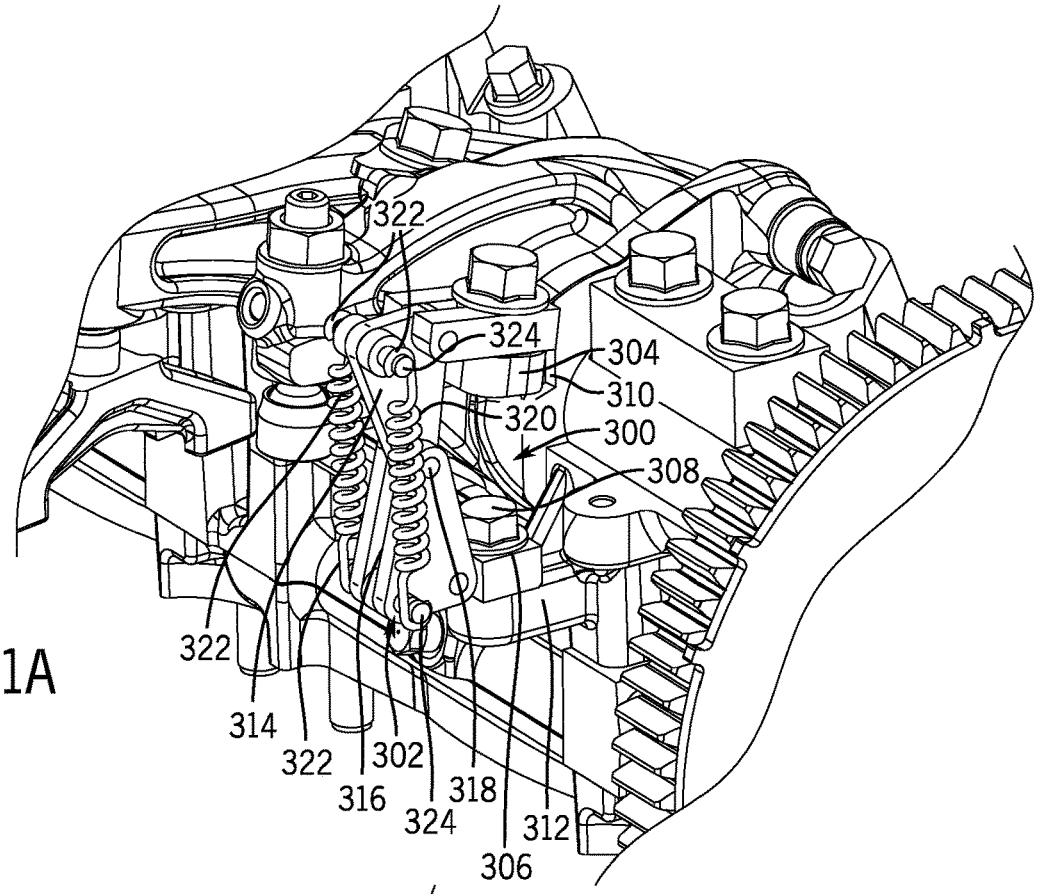
FIGS. 11A and 11B are partial perspective views showing another alternate example engine brake with another example anti-clatter assembly in respective active and inactive states.
Figure 11B:
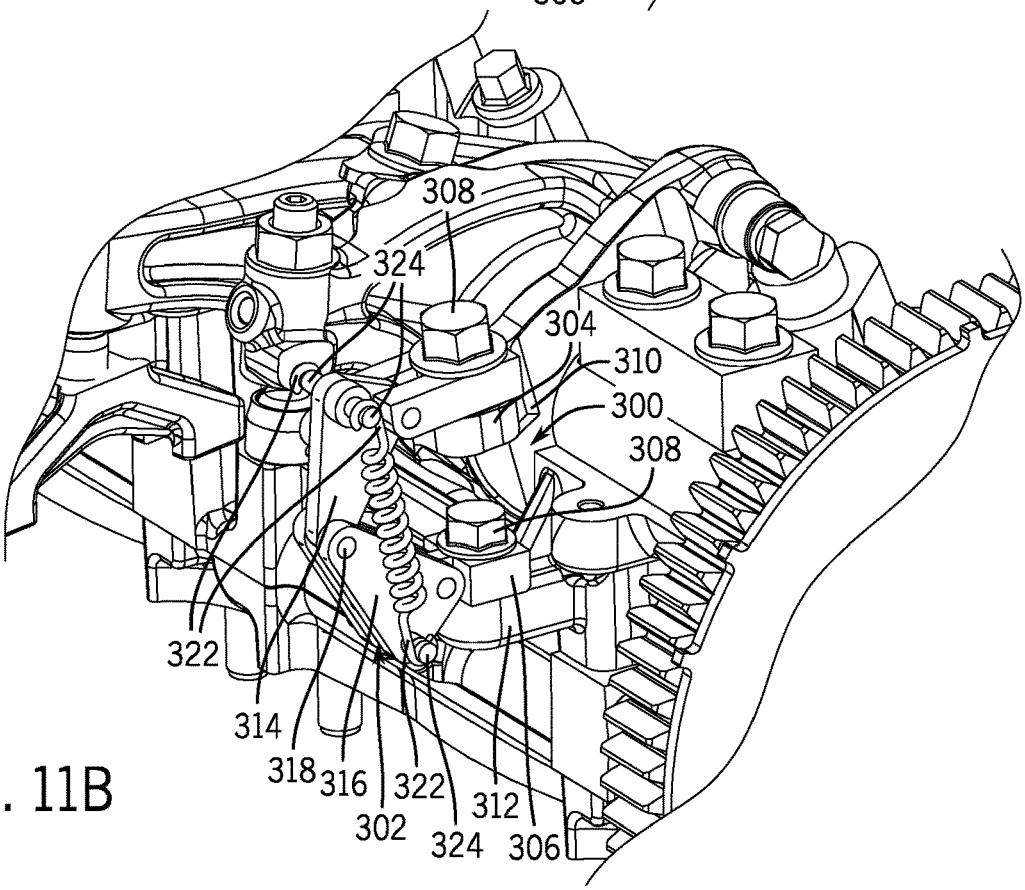

Referring now to FIGS. 11A and 11B, yet another example anti-clatter assembly 300 will now be described in which the anti-clatter assembly 300 is another spring and linkage mechanism. Generally, the anti-clatter assembly 300 replaces the return spring 92 described in the first example implementation and serves the dual functions of providing a high restraining force biasing the activation arm 90 against the actuator piston 84 during normal unbraked engine operation and a low yielding force that reverses the spring action to assist in pivoting the eccentric 74 to activate engine braking. The yielding force is low enough to allow the eccentric 74 to return to the normal lift profile orientation by the retraction of the actuator piston 84.

Specifically, the linkage 302 is coupled to the eccentric 74 and fixed to the engine 28, such as at the valve block 42 (or alternatively the engine brake housing 80) by pivot mounts 304, 306, which include bolts 308 that thread into corresponding threaded openings. The pivot mount 304 is located in a notched area 310 of the eccentric 74 and travels with the pivotal motion of the eccentric 74. The pivot mount 306 is located at an extension flange 312 of the valve block 42. Two bars 314 and 316 of the linkage 302 are coupled together at a movable pivot joint 318. In the example implementations, the bars 314, 316 are triangular and the bar 316 is formed by a pair of bars with their upper ends coupled to the lower end of the bar 314 at opposite sides of the bar 314. The opposite ends of the bars 314, 316 are pivotally coupled to the pivot mounts 304, 206, respectively.

Dual extension springs 320 (or alternatively a single extension spring) have hook ends 322 coupled to posts 324 extending from the bars 314, 316 at the corners thereof opposite the pivot joint 318 and the pivot mounts 304, 306. In the active state of the anti-clatter assembly 300 shown in FIG. 11A in which the anti-clatter assembly 300 is functioning to resist clatter during normal unbraked operation of the engine 28, the extension springs 320 are located to a side of the pivot joint 318 opposite the eccentric 74 (or valve block 42). That is, the pivot joint 318 is located between the extension springs 320 and the eccentric 74 (or valve block 42). In this state, the extension springs 320 are stretched the furthest and apply a high compressive force on the corners of the bars 314, 316 tending to resist pivotal motion of the eccentric 74. In this state, the extension springs 320 thus provide the high restraining force resisting clatter of the eccentric 74. In the inactive state of the anti-clatter assembly 300 shown in FIG. 11B, the extension springs 320 are located between the pivot joint 318 and the eccentric 74 (or valve block 42). That is, the pivot joint 318 is located to the outside of the extension springs 320 at a side opposite the eccentric 74 (or valve block 42). In this state, the extension springs 320 are stretched less than the active state shown in FIG. 11A and apply a lower compressive force on the corners of the bars 314, 316. In this condition in which the linkage is buckled and the pivot joint has passed (over center) from the inner side of the extension springs 320 to the outer side, the spring action is reversed so that the spring force tends to assist pivotal motion of the eccentric 74 to activate engine braking. As noted, the spring force is low enough such that the anti-clatter assembly 300 does not inhibit the eccentric 74 from returning to the normal lift profile orientation by the retraction of the actuator piston 84. The anti-clatter assembly 300 thus securely arrests aberrational clattering of the eccentric 74 during unbraked normal engine operation without impeding the activation and deactivation of engine braking.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, unless otherwise limited or modified, lists with elements that are separated by conjunctive terms (e.g., "and") and that are also preceded by the phrase "one or more of" or "at least one of" indicate configurations or arrangements that potentially include individual elements of the list, or any combination thereof. For example, "at least one of A, B, and C" or "one or more of A, B, and C" indicates the possibilities of only A, only B, only C, or any combination of two or more of A, B, and C (e.g., A and B; B and C; A and C; or A, B, and C).

The description of the present disclosure has been presented for purposes of illustration and description, but it is not intended to be exhaustive or limited to the disclosure in the form disclosed. Many modifications and variations will be apparent to those of ordinary skill in the art without departing from the scope and spirit of the disclosure. Explicitly referenced embodiments herein were chosen and described in order to best explain the principles of the disclosure and their practical application, and to enable others of ordinary skill in the art to understand the disclosure and recognize many alternatives, modifications, and variations on the described example(s). Accordingly, various embodiments and implementations other than those explicitly described are within the scope of the following claims.

What is claimed is:

1. An engine brake for an engine having a rocker shaft carrying rocker arms, the engine brake comprising:

an eccentric mounted to the rocker shaft and coupling one of the rocker arms to the rocker shaft to pivot eccentrically as the eccentric pivots about the rocker shaft, the eccentric being in a braked condition or an unbraked condition;

an actuator capable of pivoting the eccentric about the rocker shaft to move the eccentric from the unbraked condition to the braked condition; and an anti-clatter assembly movable from an active state associated with the unbraked condition of the eccentric to an inactive state associated with the braked condition of the eccentric, the anti-clatter assembly providing to the eccentric a restraining force in the active state and no force or a yielding force in the inactive state, the restraining force being greater than the yielding force, the restraining force being sufficient to impede the eccentric from pivoting about the rocker shaft in the unbraked condition and the yielding force being insufficient to impede pivoting of the eccentric in the braked condition.

2. The engine brake of claim 1, wherein the anti-clatter assembly includes a latch pin configured to engage the eccentric to provide the restraining force in the active state.

3. The engine brake of claim 2, further including an engine brake housing defining, at least in part, a hydraulic circuit and a pressure chamber in fluid communication with the hydraulic circuit;

wherein the latch pin is disposed in the pressure chamber and is driven by hydraulic pressure of the hydraulic circuit into an active position in which the latch pin physically abuts the eccentric to impede the eccentric from pivoting about the rocker shaft in the unbraked condition.

4. The engine brake of claim 3, wherein the eccentric includes a recess into which the latch pin is disposed in part;

wherein the latch pin translates along a pin axis that is parallel to and offset from the rocker shaft; and wherein the recess is centered on a recess axis that is parallel to and offset from the pin axis and the rocker shaft.

5. The engine brake of claim 4, wherein the latch pin has a tapered head that narrows to a tip at a distal end of the latch pin;

wherein the recess has a tapered interior surface that narrows inwardly; and wherein the tapered head of the latch pin engages the tapered interior surface of the recess eccentrically with respect to the recess axis.

6. The engine brake of claim 5, wherein the head of the latch pin engages the interior surface of the recess.

7. The engine brake of claim 1, wherein the anti-clatter assembly includes a linkage mechanism including a spring in which the linkage mechanism effects a first spring force or a second spring force, the first spring force corresponding to the restraining force provided to the eccentric in the unbraked condition and the active state of the anti-clatter assembly and the second spring force corresponding to the yielding force provided to the eccentric in braked condition and the inactive state of the anti-clatter assembly.

8. The engine brake of claim 7, wherein the spring is a torsion spring having legs that act on the linkage mechanism to provide the first spring force and the second spring force, the legs of the torsion spring being separated at a first deflection angle to provide the first spring force and at a second deflection angle to provide the second spring force, the first deflection angle being greater than the second deflection angle.

9. The engine brake of claim 8, the linkage mechanism includes two bars pivotally connected at a joint, the torsion spring being located at the joint and having one of the legs acting on one of the two bars and the other of the legs acting on the other of the two bars.

10. The engine brake of claim 7, wherein the spring is an extension spring and the linkage mechanism has two bars pivotally connected at a joint, the extension spring having one end connected to one of the two bars opposite the joint and having another end connected to the other of the two bars opposite the joint.

11. The engine brake of claim 10, wherein the extension spring provides the first spring force corresponding to the restraining force provided to the eccentric in the unbraked condition and the active state of the anti-clatter assembly when the joint between the two bars is at a first side of the extension spring and the second spring force corresponding to the yielding force provided to the eccentric in braked condition and the inactive state of the anti-clatter assembly when the joint between the two bars is at a second side of the extension spring that is opposite the first side.

12. An engine comprising:

an engine block having cylinders;

a cam shaft arranged on the engine block and having cam lobes;

a rocker shaft carrying rocker arms configured to engage the cam lobes of the cam shaft; and an engine brake mounted to the engine block and including:

an eccentric mounted to the rocker shaft and coupling one of the rocker arms to the rocker shaft to pivot eccentrically as the eccentric pivots about the rocker shaft, the eccentric being in a braked condition or an unbraked condition;

an actuator capable of pivoting the eccentric about the rocker shaft to move the eccentric from the unbraked condition to the braked condition; and an anti-clatter assembly movable from an active state associated with the unbraked condition of the eccentric to an inactive state associated with the braked condition of the eccentric, the anti-clatter assembly providing to the eccentric a restraining force in the active state and no force or a yielding force in the inactive state, the restraining force being greater than the yielding force, the restraining force being sufficient to impede the eccentric from pivoting about the rocker shaft in the unbraked condition and the yielding force being insufficient to impede pivoting of the eccentric in the braked condition.

13. The engine of claim 12, wherein the anti-clatter assembly includes a latch pin configured to engage the eccentric to provide the restraining force in the active state.

14. The engine of claim 13, further including an engine brake housing defining, at least in part, a hydraulic circuit and a pressure chamber in fluid communication with the hydraulic circuit;

wherein the latch pin is disposed in the pressure chamber and is driven by hydraulic pressure of the hydraulic circuit into an active position in which the latch pin physically abuts the eccentric to impede the eccentric from pivoting about the rocker shaft in the unbraked condition.

15. The engine of claim 14, wherein the eccentric includes a recess into which the latch pin is disposed in part;

wherein the latch pin translates along a pin axis that is parallel to and offset from the rocker shaft; and wherein the recess is centered on a recess axis that is parallel to and offset from the pin axis and the rocker shaft.

16. The engine of claim 15, wherein the latch pin has a tapered head that narrows to a tip at a distal end of the latch pin;

wherein the recess has a tapered interior surface that narrows inwardly;

wherein the tapered head of the latch pin engages the tapered interior surface of the recess eccentrically with respect to the recess axis; and wherein the head of the latch pin engages the interior surface of the.

17. The engine of claim 12, wherein the anti-clatter assembly includes a linkage mechanism including a spring in which the linkage mechanism effects a first spring force or a second spring force, the first spring force corresponding to the restraining force provided to the eccentric in the unbraked condition and the active state of the anti-clatter assembly and the second spring force corresponding to the yielding force provided to the eccentric in braked condition and the inactive state of the anti-clatter assembly.

18. The engine of claim 17, wherein the spring is a torsion spring having legs that act on the linkage mechanism to provide the first spring force and the second spring force, the legs of the torsion spring being separated at a first deflection angle to provide the first spring force and at a second deflection angle to provide the second spring force, the first deflection angle being greater than the second deflection angle.

19. The engine of claim 18, the linkage mechanism has two bars being pivotally connected at a joint, the torsion spring being located at the joint and having one of the legs acting on one of the two bars and the other of the legs acting on the other of the two bars.

20. The engine of claim 17, wherein the spring is an extension spring and the linkage mechanism has two bars pivotally connected at a joint, the extension spring having one end connected to one of the two bars opposite the joint and having another end connected to the other of the two bars opposite the joint; and wherein the extension spring provides the first spring force corresponding to the restraining force provided to the eccentric in the unbraked condition and the active state of the anti-clatter assembly when the joint between the two bars is at a first side of the extension spring and the second spring force corresponding to the yielding force provided to the eccentric in braked condition and the inactive state of the anti-clatter assembly when the joint between the two bars is at a second side of the extension spring that is opposite the first side.

* * * * *